US010588364B2

(12) United States Patent
Walker

(10) Patent No.: US 10,588,364 B2
(45) Date of Patent: Mar. 17, 2020

(54) GLOVE

(71) Applicant: Adam Walker, Cardiff, CA (US)

(72) Inventor: Adam Walker, Cardiff, CA (US)

( * ) Notice: Subject to any disclaimer, the term of this patent is extended or adjusted under 35 U.S.C. 154(b) by 67 days.

(21) Appl. No.: 15/838,184

(22) Filed: Dec. 11, 2017

(65) Prior Publication Data

US 2018/0199643 A1 Jul. 19, 2018

Related U.S. Application Data

(60) Provisional application No. 62/432,470, filed on Dec. 9, 2016.

(51) Int. Cl.

| | |
|---|---|
| ***A41D 19/00*** | (2006.01) |
| ***A41D 13/08*** | (2006.01) |
| ***A41D 19/015*** | (2006.01) |
| ***A47G 21/00*** | (2006.01) |

(52) U.S. Cl.

CPC ..... *A41D 19/0058* (2013.01); *A41D 13/087* (2013.01); *A41D 19/0062* (2013.01); *A41D 19/0093* (2013.01); *A41D 19/01547* (2013.01); *A47G 21/00* (2013.01); *A41D 2400/44* (2013.01); *A41D 2400/52* (2013.01); *A41D 2400/72* (2013.01)

(58) Field of Classification Search

CPC ..... A41D 13/087; A41D 2400/72; A41D 19/0058; A41D 19/0062; A41D 13/081; A41D 13/082; A41D 13/084; A41D 19/01547; A41D 19/0093; A41D 2400/52; A41D 2400/44; A47G 21/001; A47G 21/10; A47G 19/18

USPC ..... 2/21; 220/507; 294/25

See application file for complete search history.

(56) References Cited

U.S. PATENT DOCUMENTS

| | | | | | |
|---|---|---|---|---|---|
| 342,341 | A | * | 5/1886 | Edwards | A61F 13/105 294/25 |
| 408,912 | A | * | 8/1889 | Chesterton | A61F 13/105 294/25 |
| 1,416,001 | A | * | 5/1922 | Detwiler | A41D 13/087 2/21 |
| 1,990,553 | A | * | 2/1935 | Koffler et al. | A41D 13/087 15/227 |
| 2,471,308 | A | * | 5/1949 | Casnati | A61B 50/20 294/25 |
| D231,513 | S | * | 4/1974 | Adams | A41D 13/087 D8/14 |
| 5,749,097 | A | * | 5/1998 | Garrett-Roe | A41D 13/087 2/21 |

(Continued)

FOREIGN PATENT DOCUMENTS

| | | | | | |
|---|---|---|---|---|---|
| FR | 2626444 | A1 | * | 8/1989 | A41D 13/087 |

*Primary Examiner* — Amy Vanatta
(74) *Attorney, Agent, or Firm* — Michael D. Eisenberg

(57) ABSTRACT

A glove device configured for one-handed engagement of a plurality of fingers of a user. The glove has a body having a plurality of covering sections extending from a first end to distal ends of the covering sections. Each covering section is configured for insertion of a finger of a user therein. The plurality of covering sections define members which elevate the first end of the glove above a support surface for distal ends of the covering sections. The glove device can be formed in stacks of adjacent glove device bodies where each has covering sections engaged within the axial cavities of another of the stack.

3 Claims, 5 Drawing Sheets

(56) References Cited

U.S. PATENT DOCUMENTS

| | | | | | |
|---|---|---|---|---|---|
| 6,145,128 | A | * | 11/2000 | Suzuki | A41D 13/087 2/21 |
| D558,929 | S | * | 1/2008 | Bleakney | A61F 13/105 D29/114 |
| D634,898 | S | * | 3/2011 | Lion | D29/119 |
| D724,272 | S | * | 3/2015 | Nielson | A61B 50/20 D29/118 |
| D831,896 | S | * | 10/2018 | Krahe | D29/114 |
| 10,136,686 | B2 | * | 11/2018 | Savides | A41D 13/087 |
| D849,360 | S | * | 5/2019 | Lugar | D2/622 |
| 2014/0028039 | A1 | * | 1/2014 | Rampersad | A47G 21/10 294/99.2 |
| 2015/0189930 | A1 | * | 7/2015 | Roth | A41D 19/0024 2/163 |

* cited by examiner

GLOVE

This application claims priority to U.S. Provisional Patent Application Ser. No. 62/432,470 filed on Dec. 9, 2017 which is incorporated herein in its entirety by this reference thereto.

BACKGROUND OF THE INVENTION

1. Field of the Invention

The present invention relates generally to hand coverings such as gloves used to insulate or otherwise separate contact of the surface of the fingers of a user, with an object being touched thereby. More particularly, the invention relates to a glove device which is configured for easy ingress and egress which provides a partial covering for a plurality of fingers of a user. The glove device is configured to self support itself in a position rendering it easily engaged to the fingers of a user.

2. Prior Art

Gloves and finger protection have been used by men and women alike for hundreds of years. In some cases, gloves are employed as covering for the entire hand to protect the wearer from cold, or heat, or moisture, or other environmental conditions, which are uncomfortable to the hand over extended durations of time. Gloves are also employed by users to form a protective barrier to the exterior surface of fingers of a user where such users anticipate contact by their fingers with dirt, grime, food, chemicals, excessive heat, electrical conductors, excessive cold, and for other reasons where one would wish to, or be required to, maintain separation of the surface of a user's fingers, from what is being touched.

However, the use of gloves conventionally requires the time-consuming engagement of each of the individual fingers of the hand, along with the palm of the hand, within the glove itself. Such can be frustrating for example in the case of tight plastic or polymeric gloves, and for tight fitting fabric gloves. Further, there are many occasions where the wearing of gloves to shield fingers from a surface, or enhance the grip of fingers with such a surface, requires more time to engage the gloves, than the temporary contact, by a plurality of fingers with the anticipated surface, is worth.

Such can occur regularly, for example, for a person working with fasteners, such as nuts and bolts, where they wish to momentarily shield one or more fingers from contact with a nut or bolt, but also wish to be able to quickly remove the glove. This is because, despite their protective ability from heat and cold and grease and grime, gloves also inhibit the sense of touch of the fingers of the wearer. Such inhabitancy can be good where contact with an object is overly cold or hot or greasy. However, the loss of this sense is a problem where the user needs to feel a surface or use fine motor skills which require their cognizance, or feel of what they are touching.

The device herein disclosed provides a finger covering glove device which is configured in a fashion, enabling a wearer to easily cover portions of fingers extending to their distal ends of plurality of fingers quickly, and only when needed. The disclosed device is also configured to allow the user to also quickly and easily disengage the covering from their fingers. Still further, the glove device herein is configured to allow the user to only cover the individual fingers of the user anticipated for use in manipulating the object of choice, thereby leaving the remaining fingers employable for use where a sensitive sense of touch may be required.

The forgoing examples of related art, as to finger and hand coverings, such as gloves, and the limitations related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The glove device herein disclosed and described provides a solution to the shortcomings in prior art with regard to finger and hand covering glove devices.

The glove device herein features a glove body having a finger covering assembly, formed of a plurality of finger covering sections extending from a palm shield at a first end of the glove body. The finger covering sections are elongated and adapted for positioning upon a support surface in a fashion which maintains the openings communicating through the palm shield with the finger-engageable covering sections in an upright and expanded configuration. Such holds the openings of each of the plurality of finger covering sections, adapted for easy passage of fingers of a user, into and out of the axial cavity of each respective finger covering section.

In all modes of the disclosed device the plurality of covering sections forming the assembly, are operatively connected with each other at a first end of the body of the glove device, in a fashion configured to maintain each opening in the finger covering communicating with each respective covering section, in an expanded configuration. Such allows for ingress and egress of fingers of the user through the respective opening in the palm shield into and out of the axial passages of each of the covering sections. While shown in the drawings as covering a length on the fingers extending from the distal ends of fingers toward the palm of the hand, that length and resulting axial passage for covering the chosen number in the plurality of fingers can vary, and be longer or shorter as needed.

The glove assembly formed features a body having a plurality of finger covering sections extending from a palm shield located at a first end of the glove body. Each of the chosen plurality of finger covering sections is molded into a spaced positioning from the other finger covering sections, and each extends from the palm shield. Both the palm shield of the glove body and the plurality of finger covering sections may be formed as a unitary structure, such as by injection molding or blow molding or the like.

A polymeric or woven, or knitted or non woven material forming each covering section, and body of the glove assembly itself, can be formed in a fashion to yield a skeletal structure. It is also anticipated the device may be formed of paper, waxed-paper or coated woven or unwoven material such as a coated scrim of fabric paper or the like. This skeletal structure maintains a configuration of the body of the glove assembly which is upright and easily engaged and thereby adapted for easy use.

Alternatively, a skeletal or position-fixing structure may be operatively connected with each of the formed finger covering sections in the finger covering glove assembly. This skeletal structure may be a separate structure and operatively engaged with each of the plurality of finger covering sections of the body of the glove assembly defining the device, such as by adhesive or co-molding.

This skeletal or position-maintaining structure may also be formed of a polymeric or other material which is rigidly elastic. So formed, the skeletal structure can connect with each of the elongated finger covering sections in a biased engagement which all of the plurality of finger coverings in the body of the glove assembly. This forms the body of the device with the finger covering sections extending from the palm shield at the first end of the body of the device, by default in an expanded configuration. As can be discerned, in this expanded configuration, the glove device is configured for unencumbered insertion of the fingers of the user, through the plurality of openings in the palm shield section of the body, and directly into each of the axial cavities within each of the plurality of covering sections in the glove assembly. Once so inserted, each of the covering sections surrounding a respective finger or thumb of the user is easily moved and compressed toward a contact with the exterior surface of an object to be gripped. As also can be discerned, forming each device in this expanded configuration allows for stacking of a plurality of such devices engaged with each other.

Each of the covering sections in the plurality forming a finger covering assembly, may be customized in its configuration. While the glove body may be made from paper, coated paper or the like, woven, non woven, or other material which is flexible and elastic, currently forming the palm shield and covering sections of a polymeric or plastic material is preferred. However, it is anticipated that depending on the use, that the device can be configured of other materials such as tissue paper or coated paper or a polymeric coated scrim or the like. Each of the chosen number in the plurality of covering sections extending from the palm shield of the body of the device, may have interior surface areas which are formed of material which is thicker than sections of the body opposite the interior surface area which may be thicker. Alternatively, the interior surface forming the covering sections might be thinner than that of the exterior, for instances such as where heat may be present in the area surrounding an object, but a tactile sense of feel is more desirable during gripping of the object.

Additionally, portions of the covering sections can have areas which are thicker or otherwise configured to provide an insulation from the object to be touched, such as a hot, cold, object or one having electric current.

With respect to the above description, before explaining at least one preferred embodiment of the herein disclosed invention in detail, it is to be understood that the finger covering assembly formed of a plurality of covering sections is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed finger covering assembly system and method. It is important, therefore, that the claims be regarded as including such equivalent construction and methodology insofar as they do not depart from the spirit and scope of the present invention.

It is an object of this invention, to provide a glove device which is easily engaged with, and disengaged from a plurality of digits of the first hand of a user, without the need of using the second hand of the user to pull the finger coverings onto the fingers.

It is a further object of this invention to provide such a glove device, which is formed with a plurality covering sections for a plurality of fingers, where the covering sections support the body of the glove device upright on a support surface with openings to the covering sections expanded.

It is yet another object of this invention, to provide such a glove device, which is stackable by insertion of a plurality of glove devices into adjacent such glove devices to form a stack, where each glove device at a top of the stack, is positioned for one handed easy engagement of the fingers of the user therein.

Additional objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting.

Figure 2A:
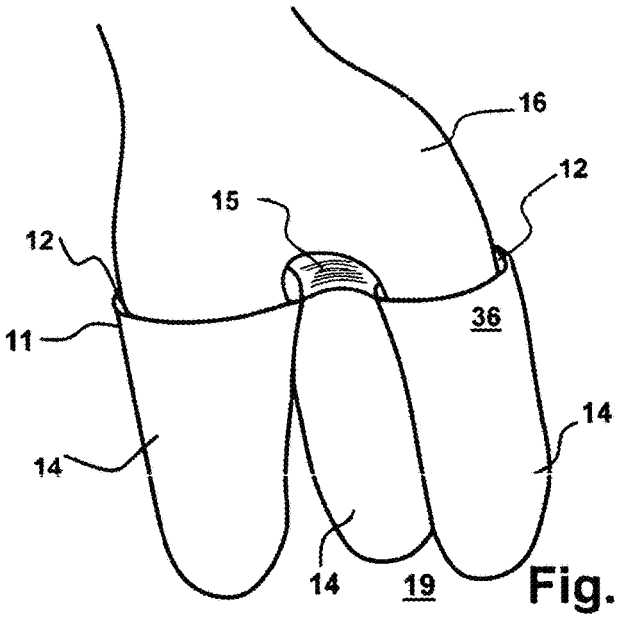
FIG. 2 shows the glove device as in FIG. 1, during one handed engagement by insertion of the plurality of fingers of one hand of the wearer, into a respective open and engageable covering sections supporting and extending from the body of the glove device.

FIG. 2*a* shows a glove device wherein longer finger covers extend from a formed palm shield of the body during a one-handed engagement with the plurality of fingers of one hand of the wearer, showing that any of the modes of the device herein can vary the length of the coverings.

Figure 1:
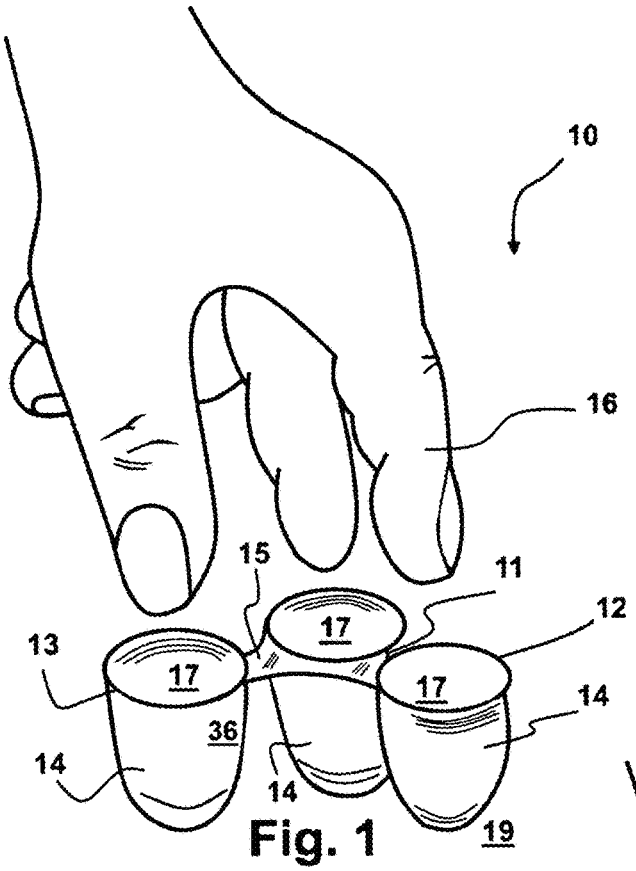
FIG. 1 shows a perspective view of a finger covering glove device herein supported by the plurality of covering sections extending from a palm shield area at a first end, which adapts each of the covering sections for easy one-handed engagement upon each of a plurality of the fingers of the hand of a wearer.
Figure 3:
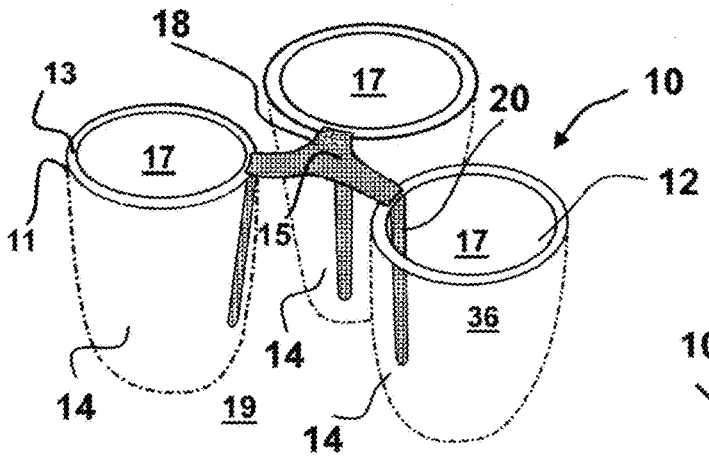

FIG. 3 depicts a mode of the device of FIG. 1, wherein a skeletal structure is engaged with each of the covering sections such as into a wall of the material forming the covering sections or into the interior facing side of a plurality of covering sections of the device to hold them in position.

Figure 4:
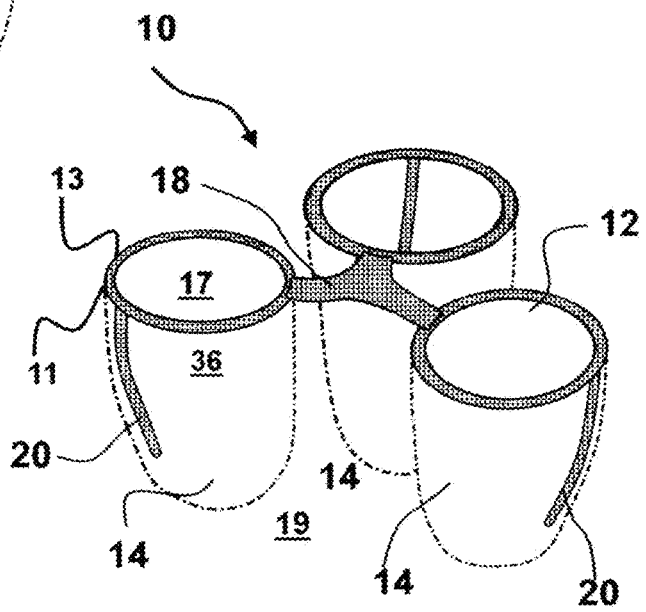

FIG. 4 depicts a mode of the device of FIG. 1, wherein a skeletal structure is engaged with within the sidewall or on the exterior side of each of the plurality of covering sections of the device to hold them in position.

Figure 5:
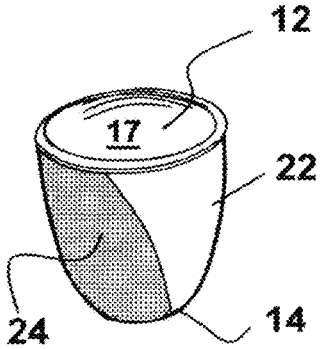

FIG. 5 shows a perspective view of a single covering section employable for all of the modes of the device herein as one or the plurality of coverings, showing an interior facing surface being thicker than the exterior facing surface.

Figure 6:
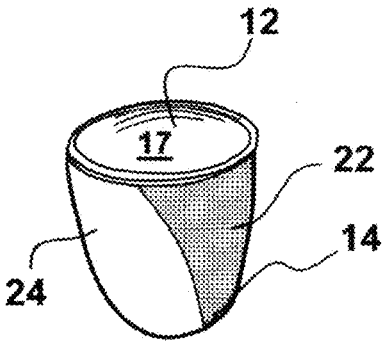

FIG. 6 shows a perspective view of a single covering section employable for some or all of the plurality of coverings for a finger of the user, showing an exterior facing surface being thicker than the interior facing surface.

Figure 7:
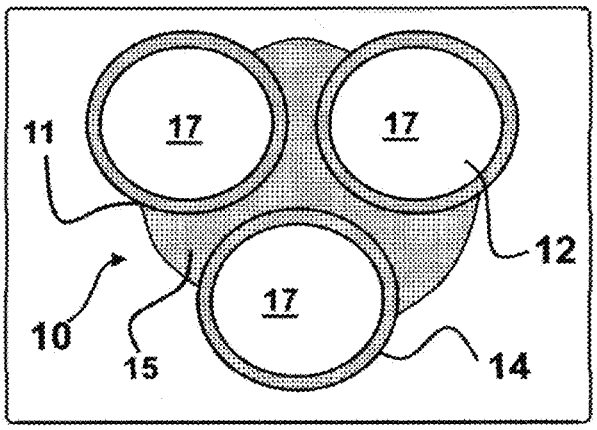

FIG. 7 depicts a top plan view of the device herein such as in FIGS. 1, 3-4, or FIGS. 10-13, showing the body of the glove device in the configuration adapted for easy one-handed engagement and disengagement with a plurality of three fingers of the wearer.

Figure 8:
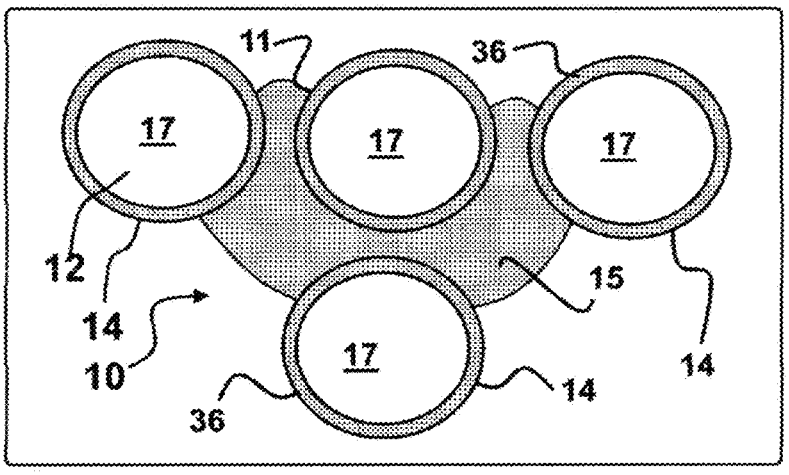

FIG. 8 depicts a top plan view of the device herein such as in FIGS. 1, 3-4, or FIGS. 10-13, showing a configuration adapted for easy engagement and disengagement with a plurality of four fingers of the wearer.

Figure 9:
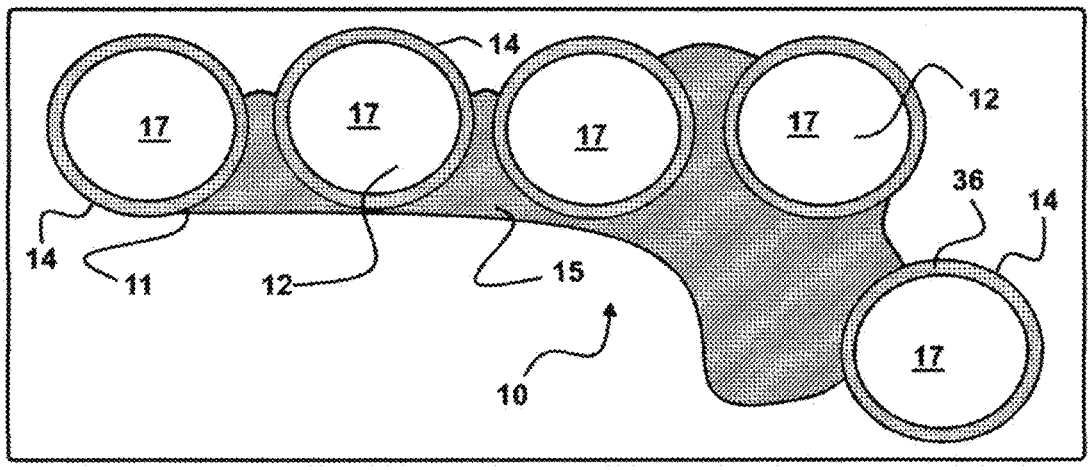

FIG. 9 depicts a top plan view of the device herein such as in FIGS. 1, 3-4, or FIGS. 10-13, showing a configuration adapted for easy engagement and disengagement with a plurality of five fingers of the wearer.

Figure 10:
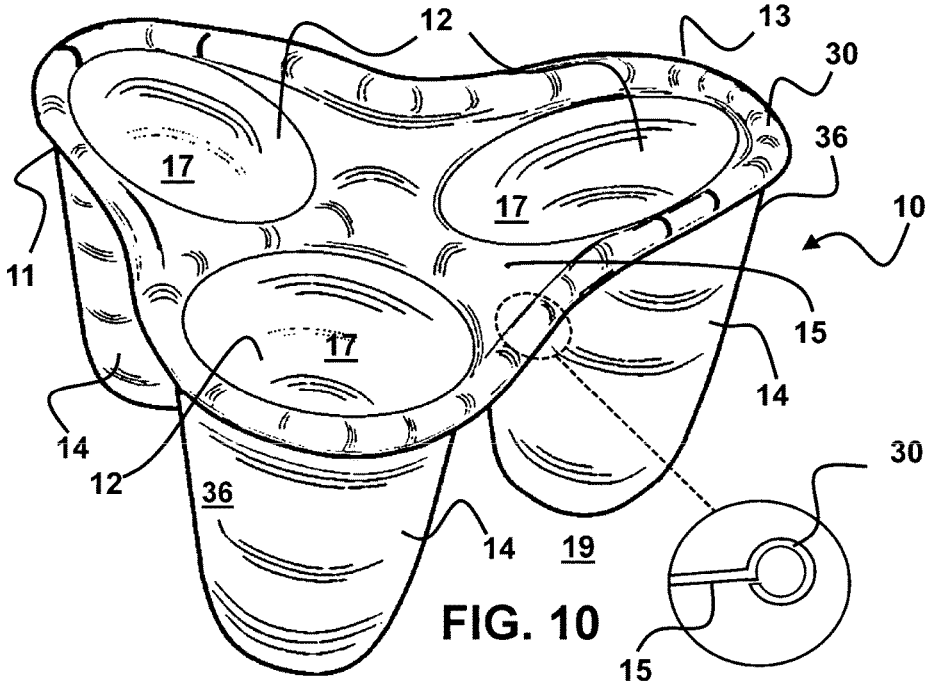

FIG. 10 shows a mode of the device formed as a unitary structure having a plurality of elongated covering sections extending from the first end of the body and a curved or circular perimeter edge portion at the first end of the body, which forms a skeletal structure to hold the openings expanded.

Figure 11:
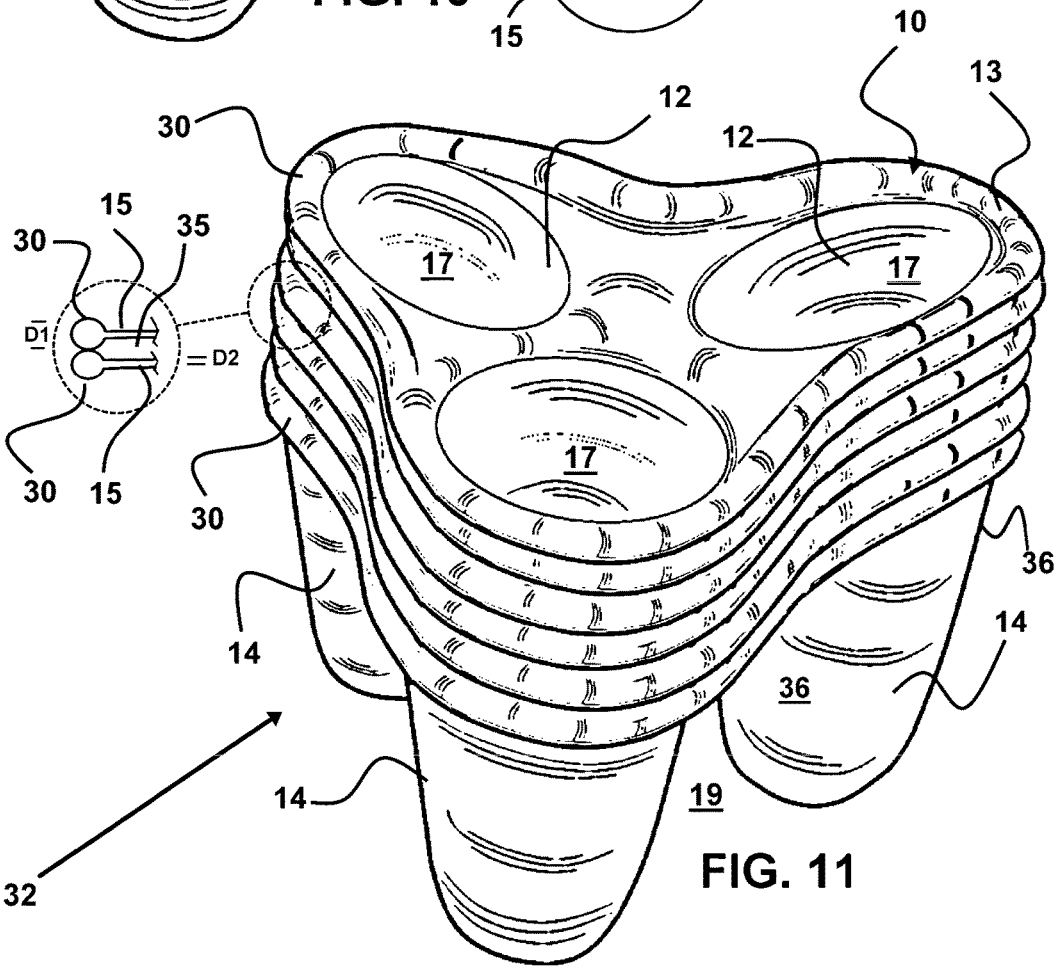

FIG. 11 shows the device as in FIG. 10 in the stacked configuration enabled by the fact each of the covering sections and the openings communicating therewith are formed to be held expanded, and showing the curved edge portions providing an easy separation of each device in the stack from the other.

Figure 12:
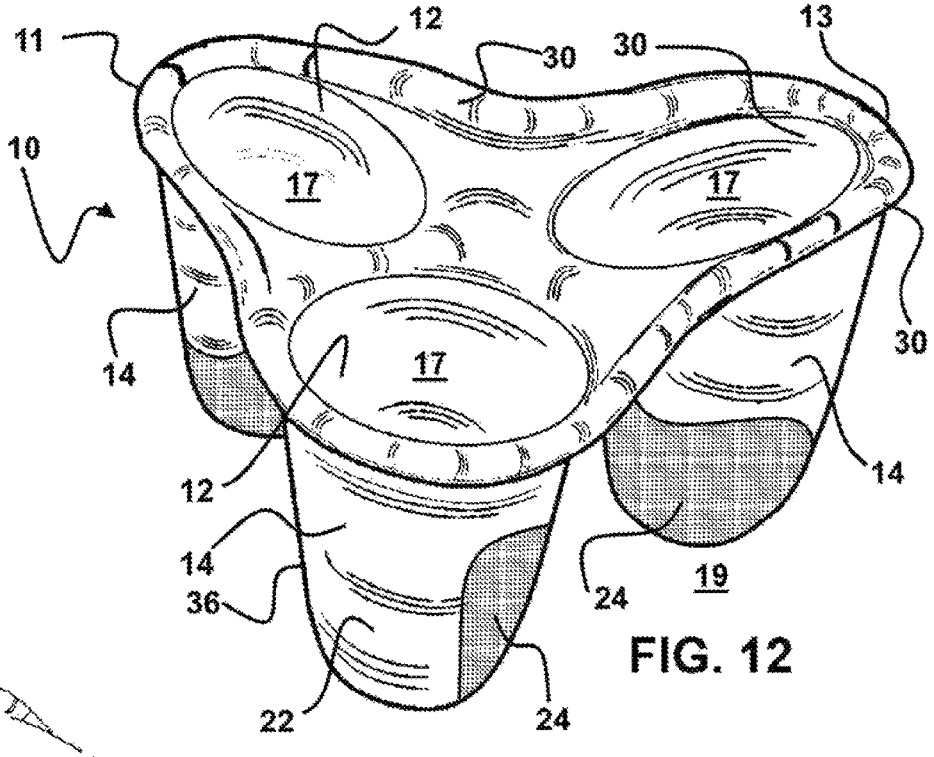

FIG. 12 depicts the device as in FIGS. 10-11, showing facing interior side portions which oppose or face interior side portions of the other covering sections extending from the first end of the body of the device which are textured for better gripping, thicker for insulation, or both.

Figure 13:
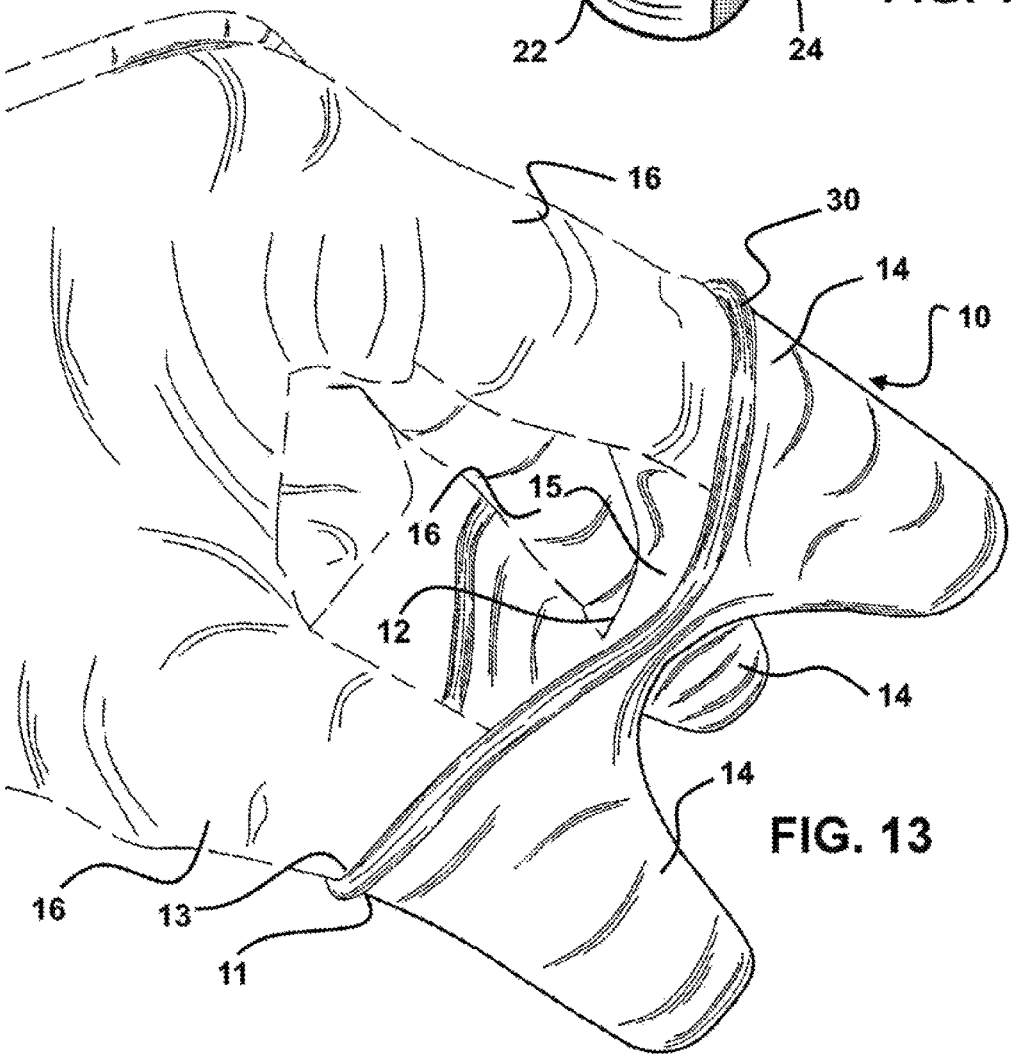

FIG. 13 shows the device of FIGS. 10-12 in an engaged position, operatively positioned with a plurality of three fingers of the user, inserted through openings and into axial cavities of a plurality of covering sections extending from a first end of the body of the device, and showing the elastic polymeric material forming the body of the device being stretched.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-13, wherein similar components are identified by like reference numerals, there can be seen in FIG. 1, a perspective view of the body 11 of a glove or finger covering device 10 herein. In all modes of the device 10 herein it is configured to be self-supported upon a surface, and constructed in a fashion wherein the openings 12 at a first end 13 of the body 11 which communicate through a palm shield 15 at a first end 13 of the body 11 and communicate with axial cavities 17 of the plurality of finger-engageable covering sections 14, are easily engaged with fingers 16 of a user.

Such self supporting on the plurality of extended finger coverings 14 in all modes of the device 10, is accomplished by forming the body 11 of the device 10 and the sidewalls 36 of the plurality of finger coverings 14 extending away from the first end 13 of the body 11, of a material and structure and number, which define a plurality of hollow support members adapted to hold and maintain the first end of the body 11, elevated above a support surface 19, and holding both the openings 12 and the axial cavities 17 of each covering section 14, in an expanded configuration. This forms the device 10 in a manner adapted for easy one-handed engagement of fingers 16 of one hand of the user, into the respective axial cavity 17, of each respective covering section 14, with the hollow covering sections 14 defining support members which concurrently holding the first end 13 of the body 11 with the openings 12 enlarged, elevated above the support surface.

Figure 2:
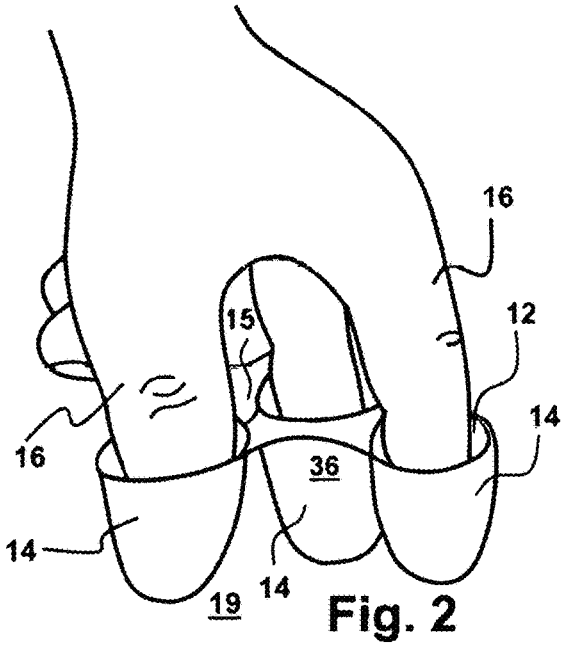

Such a one-handed engagement, which is available in all modes of the device 10 in all drawings herein, is depicted in FIG. 2. As shown the fingers 16 of one hand of the user, such as the thumb and two fingers, are easily engaged within the formed axial cavities 17 of a respective covering section 14, by simple passage thereof through the respective opening 12 at the first end of the body 11 which is held open. Such an engagement, and disengagement is as noted, a chief object of the glove device 10 herein, where each of the plurality of covering sections 14 is operatively connected to the body 11 of the device at the first end 13 thereto, and held adjacent the other covering sections 14 such as by engagement with the palm shield 15 area. The material forming the glove device 10 and portions thereof is configured to form the body 11 of the device 10 where each respective opening 12 through the palm shield 15 communicating with a respective axial cavity 17 of a covering section 14, is by default held expanded such that engagement only requires insertion by one hand.

FIG. 2*a* shows the device 10 in any mode herein depicted with the formed covering sections 14, for the plurality of fingers 16 of a hand, which are varied in length to form covering sections 14 which project from the palm shield 15 at the first end 13 of the body 11, which are longer in length. As depicted, the finger covering sections 14 join at the first end 13 of the body 11 and have respective openings 12 which are held expanded and communicate into a respective axial cavity 17. The openings 12 at the first end 13 of the body 11 of the device 10, can be held in registered positions by the palm shield 15 to space them apart, or could be engaged by the perimeter edges of the openings 12 with each other.

The depicted variance in length shown in this longer mode of the device 10, while shown with a plurality of three fingers 16 covered with covering sections 14, in all modes herein could be formed with any number of a plurality of covering sections 14 to cover any number of fingers of the user. In all such modes of the device 10 herein, the length of projection of the covering sections 14 may be varied for the task or situation of anticipated use of the glove device 10. With the longer lengths of such covering sections 14, the palm shield 15 is preferred to shield the palm of the user during use, and to provide a layer of the body 11 though which the openings 12 communicate and are held in registered positions separated from each other.

FIG. 3 depicts a mode of the device 10 such as shown in FIGS. 1-2, wherein the body 11 of the device 10 includes the plurality of covering sections 14 which are operatively connected with each other at a first end 13 of the body 11. As shown, the openings 12 at the first end are maintained in registered spaced positions, and maintained by default expended for ingress and egress of fingers 16 of the user.

A skeletal structure 18 may be provided to hold the openings 12 open and operatively spaced from each other, and to engage and hold each of the covering sections 14 to the formed body 11 which as in other modes includes a plurality of such covering sections 14 projecting from the first end 13 and a plurality of space openings 12 for one-handed engagement of the fingers 16 therethrough. This skeletal structure 18 may be formed as part of a unitary mode of the device 10 by for example co-molding of the body 11, or it may be operatively engaged with each of the plurality of covering sections 14 employed with the body 11 of the device 10 such as with adhesive or insertion into passages formed in the sidewalls 36 defining the conduit-like covering sections 14. Such skeletal structure 18 may be employed with any mode of the device 10 herein and in the mode with the shorter covering sections 14 of FIGS. 1 and 2, or the longer covering sections 14.

This skeletal structure 18, may also be formed of a rigid yet elastic material, which, when engaged with each of the covering sections 14, will impart a resistive bias with each of the covering sections 14 of the body 11 of the device 10 to form the device 10 in an expanded configuration, adapted for insertion of the fingers 16 of the user through the openings 12 in each covering section 14.

With the fingers of the user so inserted, the user may compress each of the covering sections 14 toward a common center area therebetween, to grip an object within a finger-forced contact of each of the covering sections 14 therewith. When the wearer is done gripping or holding the object between the compressed contact of the plurality of covering sections 14, relaxing the fingers 16 will allow the skeletal structure 18 engaged with each of the covering sections 14 to return them to the expanded configuration such as in FIG. 1.

FIG. 4 depicts the device 10 where the engaged skeletal structure 18, connects with a plurality of ribs 20 which engage each of the covering sections 14, either in a slot in the sidewall 36 thereof, or about an area of the covering sections 14 at the exterior side 22 opposite the interior side 24 which is forced by the fingers 16 to a compressive contact with an object. This positioning still provides the noted biased engagement with the covering sections 14 to cause a return thereof to the expanded configuration, but leaves the interior side 24 free to flexibly contact the object of choice.

Also shown in FIG. 4, is the extension of the skeletal structure 18 to engage with and surround the openings 12 to maintain them expanded. However, such may also be accomplished as in FIG. 3, where the covering sections 14 are formed in a fashion with a perimeter edge of the openings 12 adapted to hold them in the expanded configuration.

FIG. 5 depicts a perspective view of a single covering section 14 used in the formation of a plurality of covering sections 14 in any mode of a device 10 herein having a plurality of covering sections 14 operatively connected. As shown, the covering section 14 has an interior facing surface 24 which is formed of material which is thicker than the facing exterior surface 22. By interior facing surface 24 is meant, a surface of the covering section 14, which when engaged and extending from the first 13 of the body 11 of the device 10, faces or opposes each of the other sections 14. The interior facing surface 24 might also be configured with ribs or textures or other configurations to enhance gripping.

FIG. 6 shows a perspective view of a single covering section 14 for a finger 16 of the user showing an exterior facing surface 22 being thicker than the interior facing surface 24. Such might be employed where heat or electrical voltage surround an object to be gripped by the covering sections 14 of the device 10.

FIGS. 7-9 depict varying top plan views of the device 10 herein such as in FIG. 1-2 or FIG. 2*a* or 11-13. In FIGS. 7-9 is shown that the number of the plurality of covering sections 14 and their configuration into a body 11 forming the device 10 can vary. The palm shield 15 may be formed at the first end 13 of the body 11 in all configurations which employ longer covering sections 14 or where the device 10 in any mode shown or describe herein, is formed as a unitary structure such as by molding of a polymeric material. Such polymeric material may be one or a combination of polymeric material such as from a group of such polymeric materials including polyethylene, polypropylene, neoprene, nitral, latex, nylon, and rubber. Additionally, in some instances the device may be formed of paper, polymeric coated paper, tissue paper, or a scrim of textile material coated with a polymeric coating.

FIG. 10 shows a mode of the glove device 10 herein which is formed as a unitary structure. The body 11 of the device 10 has a plurality of elongated covering sections 14 extending from the first end 13 of the body 11 from a palm shield 15 portion thereof. As with other modes of the device 10, this plurality of covering sections 14 defines a plurality of support members to hold the first end 13 of the body 11 elevated above the support surface 19. In this elevated position of the first end 13, the openings 12 communicate into the respective axial cavities 17 of each of the covering sections 14 at the first end 13. This is shown with the openings 12 communicating through the palm shield 15 portion, shown held in an expanded configuration and in registered spaced positioning from each other. Each opening 12 communicates with an axial cavity 17 of a respective elongated covering section 14 extending from a sealed connection with the palm shield 15 portion of the body 11 to a distal end of the axial cavity 17 where the sidewall 36 will contact the support surface 19.

A rib 30 is formed and surround the entire perimeter edge of the palm shield 15 portion at the first end 13 of the body 11. This rib 30 originally had planar surfaces on a top and bottom which worked well, but it was found during experimentation that when the rib is formed with a curved circumference or at least formed with curved surfaces on a top and bottom surface of the rib 30 where stacked ribs 30 will contact, when the devices 10 are placed in a stack as in FIG. 11, the stacked devices 10 separated much easier when a user inserted their fingers 16 into the top device 10 in the stack.

This enhanced separation was also provided by the formation of a gap 35 between adjacent palm shields 15 of adjacent devices 10 in the stack 32 as well as a minimizing in contact between the ribs 30 on adjacent devices 10 in the stack 32. This gap 35 between the palm shields 15 is caused by the thickness D1 of the rib 30 exceeding the thickness D2 of the palm shield 15 portion of the body 11 as shown for example in FIG. 11. Consequently, a curved surface on at least the mating surfaces of the rib 30 in a stack, and preferably around the exterior circumference of the ribs 30 is preferable, as well as a thickness D1 of the rib 30 exceeding the thickness D2 of the palm shield 15 portion is preferred.

Further, when engaged on the hand of the user as in FIG. 13, a rib 30 and preferably the rounded rib 30 depicted, provided a constrictor or compressive contact yielding a temporary compressive contact of the perimeter edge at the rib 30, against portions of the fingers 16 and hand of the user inserted into respective covering sections 14. This compressive contact prevented sliding off of the covering sections 14 from the engaged fingers 16 of the user, and helped maintain the device 10 in the engaged position of FIG. 13. This is caused by the increased elastic force of the thicker rib 30, and in the case of the curved rib 30, imparting of this force to a smaller curved surface area of the rib 30 in contact with the surface of the hand and fingers 16 of the user. Further, in the case of the curved shaped rib 30 shown, the rib 30 would roll slightly during enlargement and contraction of the device 10 as the hand and fingers 16 moved, and this rolling motion held the perimeter in place during hand movements better than a planar surfaced rib 30. Of course the planar surfaced rib 30 still provides increased elastic resistance and therefor increased compressive contact of the perimeter edge of the first end 13 of the device 10 against the fingers 16 and hand of a user engaged with it.

The curved or rounded rib 30 provided this enhanced may be solid, hollow, or formed by a curving of the perimeter edge of the palm shield 15 portion of the body 11 during formation. In experimentation this circular perimeter edge, or curved edge of the rib 30, running along the perimeter edge of the palm shield 15 portion of the body 11, at the first end 13 of the body 11, was also found to provide a skeletal structure which helps maintain the openings 12 expanded.

As shown in FIG. 11 the device 10 as in FIG. 10 is particularly well configured to form a stack 32 of such devices 10 which are sequentially dispensable or useable by users by removing the device 10 positioned at the top of the stack 32. This stack 32 configuration is enabled by the fact each of the covering sections 14 and the openings 12 communicating therewith are formed with the body 11 in a unitary structure which then holds both expanded held by the resistance of the rib formed at the perimeter edge of the palm shield 15 portion. Additionally, in a stack 32, this curved edge of the rib 30 minimizes contact with adjacent ribs 30 and forms curved gaps 34 between adjacent curved edges of the ribs 30 of adjacent devices 10 which allow a user to more easily contact and separate a device 10 at the top of the stack 32.

FIG. 12 depicts the device 10 as in FIGS. 10-11, showing facing surfaces 24 which oppose or face facing surfaces 24 of the other covering sections 14 extending from the first end 13 of the body 11 of the device 10. These facing surfaces 24 may be textured for better gripping, or have a sidewall 36 forming the respective covering section 14 which is thicker for insulation, or both a thicker sidewall 36 and textured exterior surface.

FIG. 13 depicts the device 10 of FIGS. 10-12 in an engaged position, operatively positioned with a plurality of three fingers of the user, inserted through openings 12 and into axial cavities of a plurality of covering sections 14 extending from a first end 13 of the body 11 of the device 10, and showing the elastic polymeric material forming the body of the device 10 being stretched by finger movement.

It should be noted and anticipated that although the finger covering having a plurality of finger covering sections herein is shown in its most simple form, various components and aspects of the device may be differently shaped or slightly modified when forming the invention herein. As such, those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the finger covering invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A glove apparatus, comprising:

a body, said body having at least three covering sections disposed in a triangular arrangement, each covering section being defined by a sidewall and extending away from a respective opening of a plurality of said openings formed at a first end of said body;

a palm shield portion of said body positioned at said first end thereof, said palm shield portion connecting to the covering sections at the first end of the body and having a perimeter edge surrounding said openings;

a rib formed on said perimeter edge, the rib having a curved exterior surface having a thickness larger than a thickness of the palm shield portion;

wherein:

each said opening communicates with a respective axial cavity running from a respective said opening at said first end of said body to a respective distal end of said covering section; and said covering sections define support members configured to support said first end of said body elevated above a support surface placed in contact with respective distal ends of each of said plurality of covering sections, whereby each of said plurality of covering sections is adapted for one handed engagement of respective fingers of a user into respective said axial cavities of said plurality of covering sections;

said covering sections having substantially equal lengths between the first end and the distal ends, such that when the glove apparatus is placed on the support surface and the distal ends of the covering sections contact the support surface, the openings are substantially level;

said rib extends into the openings to define a constrictor at the openings, said constrictor being adapted to provide a rolling compressive contact of said curved exterior surface of said rib against portions of fingers of a user respectively engaged within said axial cavities of said plurality of covering sections, such that said covering sections are thereby adapted to hold said rib in a rolling compressive engagement against the portions of fingers of the user respectively engaged within said axial cavities of said plurality of covering sections.

2. The glove apparatus of claim 1, wherein:

said rib has a thickness which is larger than a thickness of said palm shield portion.

3. The glove apparatus of claim 2, wherein:

a plurality of said bodies are configured to be engaged in a stack of adjacently positioned bodies;

each adjacently positioned body has each of said plurality of covering sections thereof, engaged through respective openings and within respective axial cavities of the adjacently positioned body; and a respective gap is formed between each respective palm shield portion of each respective adjacently positioned body in said stack.

* * * * *